US007172245B2

(12) United States Patent
Bouchard et al.

(10) Patent No.: US 7,172,245 B2
(45) Date of Patent: Feb. 6, 2007

(54) REMOVABLE SEATS SYSTEM

(75) Inventors: Paul-Andre Bouchard, Outremont (CA); Pierre Laforest, Montreal (CA); Pierre Gagnon, Montreal (CA)

(73) Assignee: Gestion Laforest Inc., St-Hubert (CA)

( * ) Notice: Subject to any disclaimer, the term of this patent is extended or adjusted under 35 U.S.C. 154(b) by 644 days.

(21) Appl. No.: 10/332,953

(22) PCT Filed: Jul. 19, 2001

(86) PCT No.: PCT/CA01/01051

§ 371 (c)(1),
(2), (4) Date: Aug. 27, 2003

(87) PCT Pub. No.: WO02/07566

PCT Pub. Date: Jan. 31, 2002

(65) Prior Publication Data

US 2004/0051354 A1 Mar. 18, 2004

Related U.S. Application Data

(60) Provisional application No. 60/219,633, filed on Jul. 21, 2000.

(51) Int. Cl.
*A47C 31/00* (2006.01)
*E04H 3/12* (2006.01)

(52) U.S. Cl. ..... 297/217.7; 297/331; 52/10

(58) Field of Classification Search ..... 297/217.7, 297/217.1, 331, 344.18, 344.19, 344.2, 257, 297/248; 52/8, 9, 10
See application file for complete search history.

(56) References Cited

U.S. PATENT DOCUMENTS

| | | | | |
|---|---|---|---|---|
| 1,517,774 A | | 12/1924 | Duprey | |
| 1,801,681 A | | 4/1931 | Mowery | |
| 2,817,389 A | | 12/1957 | Richards | |
| 5,271,190 A | * | 12/1993 | Sugiyama | 52/10 |
| 5,517,789 A | * | 5/1996 | Sugiyama | 52/10 |

FOREIGN PATENT DOCUMENTS

| | | |
|---|---|---|
| DE | 299 22 288 U1 | 3/2000 |
| FR | 2 576 952 | 8/1986 |
| FR | 2 687 713 | 8/1993 |
| FR | 2 746 435 | 9/1997 |

* cited by examiner

*Primary Examiner*—Milton Nelson, Jr.
(74) *Attorney, Agent, or Firm*—Louis Martineau

(57) ABSTRACT

A removable seats system includes a number of vertically movable platforms supported by a platform support and displacement device which engages the platforms and which positions the platforms in a horizontally successively spaced configuration defining a gap between each two successive platforms having selective independent vertical displacement of the platforms. The removable seats system further includes a number of seat elements each associated with a corresponding platform and each including: a row of seats including at least one seat; and a seat supporting structure carried by a platform and supporting the row of seats. Each one of the seat members is movable relative to its corresponding platform between an operative position in which the row of seats is located above its corresponding platform, and a concealed position in which the row of seats is located under a platform.

11 Claims, 11 Drawing Sheets

REMOVABLE SEATS SYSTEM

This application claims benefit of U.S. Provisional Application No. 60/219,633 filed Jul. 21, 2000.

FIELD OF THE INVENTION

The present invention relates to a removable seats system, and more particularly to a removable seats system including seats which may be positioned in either one of an operative position wherein persons can sit on the seats, and a concealed position wherein the seats are stored and inoperative.

BACKGROUND OF THE INVENTION

It is known to provide removable seats in multi-functional rooms. For example, some rooms are often used both as theatre rooms wherein rows of fixed seats are provided, and as conference rooms or show rooms wherein no fixed seats are required. To accommodate such hybrid rooms, removable seats systems have been incorporated into the rooms to allow the seats to be removed and installed according to the daily purpose of the room.

SUMMARY OF THE INVENTION

The present invention relates to a removable seats system comprising a number of vertically movable platforms supported spacedly over ground by a ground-resting platform support and displacement means which engages said platforms and which positions said platforms in a horizontally successively adjacent although slightly horizontally spaced configuration so as to define a small horizontal gap between each two successive said platforms, said platform support and displacement means further allowing selective independent vertical displacement of said platforms, said removable seats system further comprising a number of seat members each associated to a corresponding said platform and each comprising:

a row of seats comprising at least one seat; and a seat supporting structure carried by a said platform and supporting said row of seats;

wherein each one of said seat members is movable relative to said corresponding platform between an operative position in which said row of seats is located above said corresponding platform for allowing persons to sit on said seats, and a concealed position in which said row of seats is carried by and is located under a said platform in an inoperative and concealed condition, and wherein in said operative position of each one of said seat members, said seat supporting structure extends through said gap between two said successive platforms.

The invention further relates to a removable seats system comprising:

a number of selectively powered vertically movable platforms supported spacedly over ground by a ground-resting platform support and displacement means which engages said platforms and which positions said platforms in a horizontally successively adjacent although slightly horizontally spaced configuration so as to define a small horizontal gap between each two successive said platforms, said platform support and displacement means further allowing selective independent vertical displacement of said platforms; and a number of seat members each associated to a corresponding said platform and each comprising:

a row of seats comprising at least one seat;

a seat supporting structure carrying said row of seats; and a selectively powered seat displacement means carried by said corresponding platform and carrying said seat supporting structure, said seat displacement means being capable of moving said seat member relative to said corresponding platform between an operative position in which said row of seats is located above said corresponding platform for allowing persons to sit on said seats, and a concealed position in which said row of seats is located under said corresponding platform in an inoperative and concealed condition;

wherein in said operative position of each one of said seat members, said seat supporting structure is supported under said corresponding platform by said seat displacement means and extends through said gap between two said successive platforms to rest over said corresponding platform and support said row of seats over said corresponding platform, and wherein in said inoperative position of said seat members, said platforms may be aligned at a same height to form a flat surface which is substantially featureless.

Preferably, each said seat supporting structure includes an intermediate sheet-thick web portion which extends through said gap in said operative position of said seat member including said seat supporting structure, said gap being sized to snugly receive said sheet-thick web portion of said seat supporting structure.

Preferably, each said vertically movable platform defines a top and a bottom surface and comprises a reinforcing structure which extends for substantially the whole width and length of said platform on said bottom surface of said platform.

Preferably, said seat supporting structure includes a pivot member pivotally carried by said corresponding platform and a first portion fixedly attached to said pivot member, an intermediate web portion formed by said sheet-thick web portion, and a second portion opposite said first portion with said row of seats being fixed to said second portion, and said seat displacement means comprises a selectively powered pivoting device engaging said pivot member and selectively pivoting said pivot member for pivotally moving said seat member between said operative position and said concealed position.

Preferably, each said seat supporting structure first portion, intermediate web portion and second portion define a C-shaped plate forming a jaw engaging an edge portion of said platform.

Preferably, each said seat supporting structure second portion comprises a marginal edge portion having an abutment surface which rests on said corresponding platform in said operative position of said seat member including said seat supporting structure.

Preferably, at least two said seat members are associated to each one of said platforms.

Preferably, said platform support and displacement means comprises a number of push actuators corresponding to each one of said platforms, said push actuators resting on the ground, being attached to said platforms and allowing said platforms to be selectively independently vertically displaced through selective activation of said push actuators.

The present invention relates to a removable seats system comprising:

a number of selectively powered vertically movable platforms supported spacedly over ground by a ground-resting platform support and displacement means which engages said platforms and which positions said platforms in a horizontally successively adjacent although slightly horizontally spaced configuration so as to define a small horizontal gap between each two successive said platforms, said platform support and displacement means further allowing selective independent vertical displacement of said platforms; and a number of seat members each associated to a corresponding said platform and each comprising:

a row of seats comprising at least one seat;

a seat supporting structure carrying said row of seats; and a selectively powered seat displacement means carried by said corresponding platform and capable of carrying said seat supporting structure, said seat displacement means being capable of moving said seat member relative to said corresponding platform between an operative position in which said row of seats rests on and is located above a supporting platform for allowing persons to sit on said seats, and a concealed position in which said row of seats is located under said corresponding platform in an inoperative and concealed condition;

wherein in said operative position of each one of said seat members, said seat supporting structure extends through said gap between two said successive platforms to rest over said supporting platform and support said row of seats over said supporting platform, and wherein in said inoperative position of said seat members, said platforms may be aligned at a same height to form a flat surface which is substantially featureless.

Preferably, for each one of said seat members, said supporting platform is the same as said corresponding platform.

DETAILED DESCRIPTION OF THE EMBODIMENTS

Figure 1:
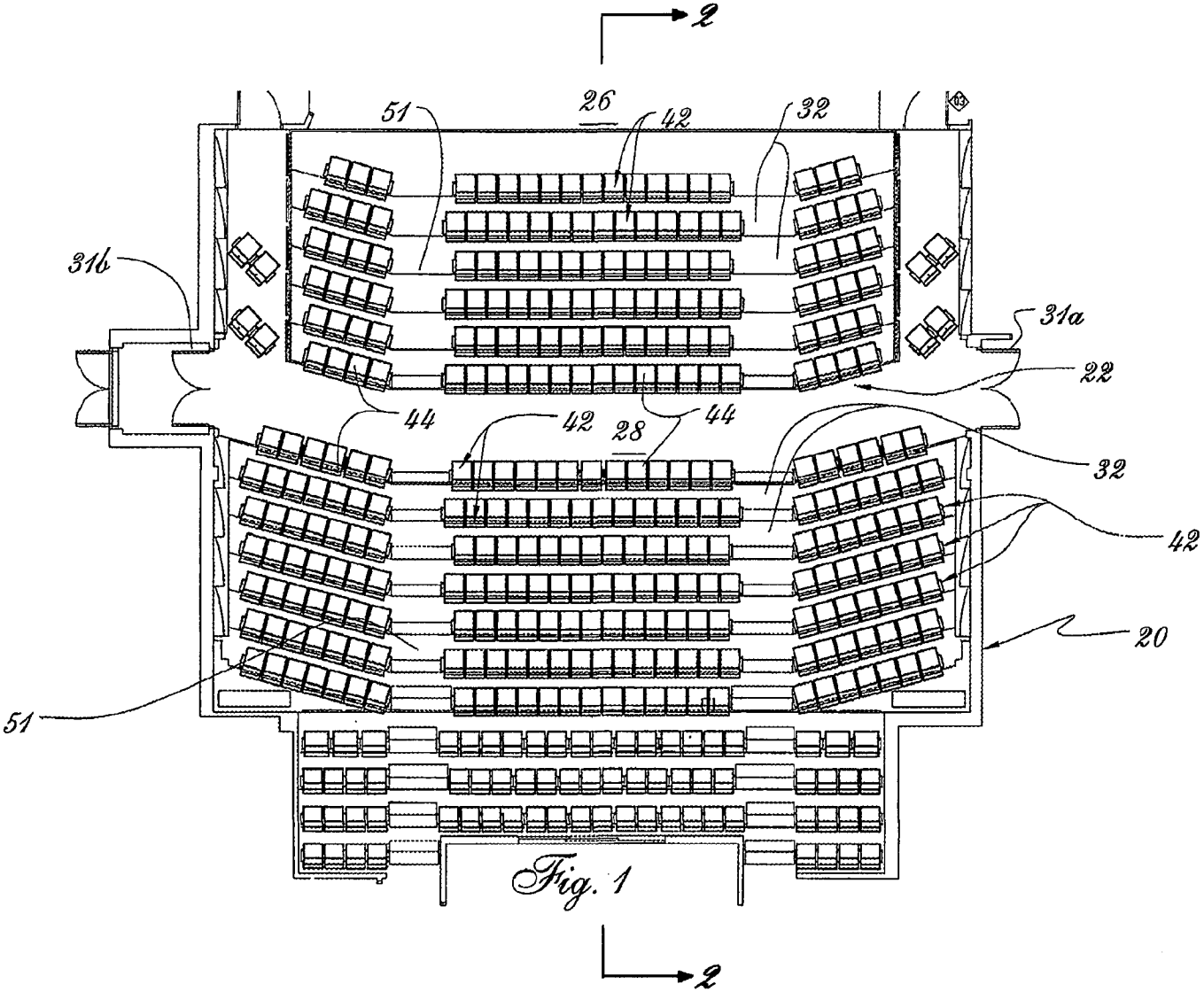
FIG. 1 is a top plan view of a hybrid room equipped with the removable seats system according to the present invention, with the seats being in an operative position.
Figure 2:
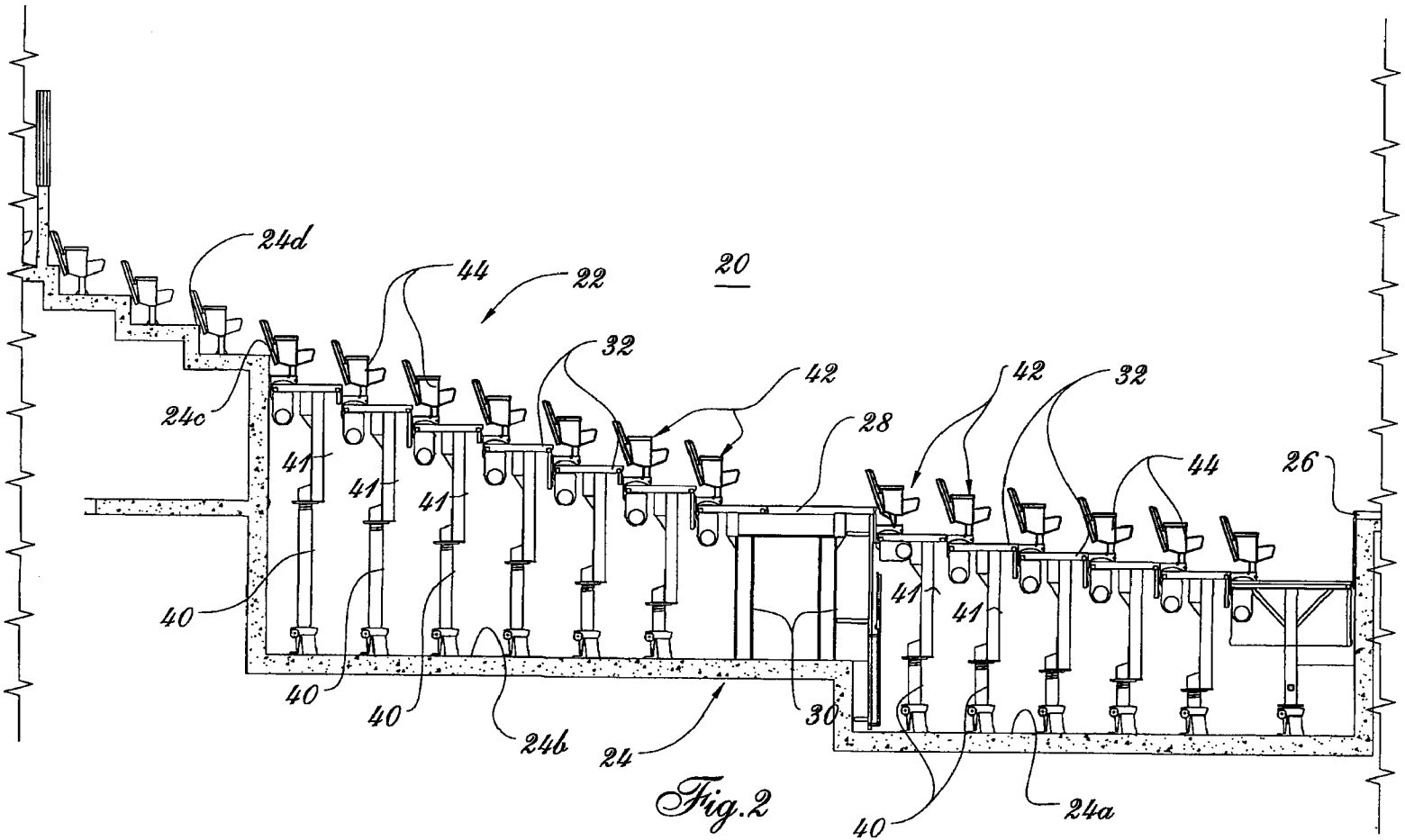
FIG. 2 is a sectional view of the room taken along line 2—2 of FIG. 1.

FIGS. 1 and 2 show a theatre room 20 provided with a removable seats system 22 according to the present invention, where FIG. 2 shows various elements in cross-section and others in side elevation. Theatre room 20 comprises a fixed floor structure 24 which may be flat and which may include more than one vertically offset levels 24*a*, 24*b*, 24*c*, 24*d*, . . . as shown in FIG. 2. A theatre scene platform 26 is located towards the front end of theatre room 20. A fixed central platform 28 is provided at an intermediate portion of room 20, supported spacedly over floor level 24*b* by fixed posts 30. Central platform 28 corresponds to the side entrance doors 31*a*, 31*b* of room 20 and further forms a walkway transversely extending through room 22.

Removable seats system 22 is located over floor levels 24*a*, 24*b* on each side of central platform 28, and comprises a number of vertically movable platforms 32 which are horizontally successively adjacent and slightly horizontally spaced so as to define a small horizontal gap between each two successive platforms 32 which will be described hereinafter. As shown in the top plan view of FIG. 1, each platform 32 is elongated and elbowed so as to be slightly concave towards the scene platform portion 26.

Figure 4:
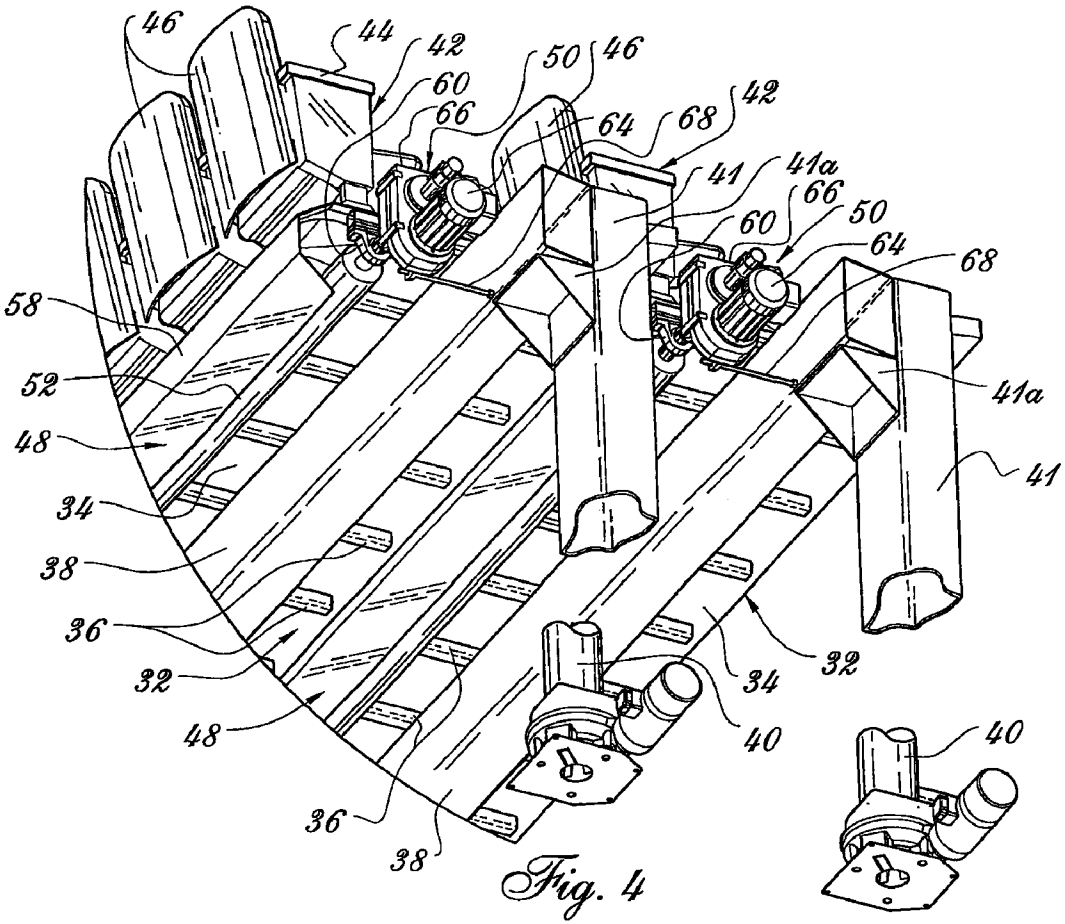
FIG. 4 is a partial bottom rear perspective view, at en enlarged scale, of two successively adjacent platforms of the removable seats system of FIGS. 1–3.

FIG. 4 shows the bottom surface of two successive platforms 32. Each platform 32 comprises a flat board 34 provided with a number of reinforcement crossbars 36 transversely fixed on the bottom surface of each platform 32. A longitudinal tubular support bar 38 having a rectangular cross-section is fixedly attached under all crossbars 36 perpendicularly thereto and extends for substantially the whole length of its associated platform 32. Thus, each platform 32 comprises a reinforcing structure covering substantially its whole bottom surface, this reinforcing structure being formed by crossbars 36 and tubular support bar 38 that respectively extend substantially the whole width and length of platform 32. This provides a sturdy configuration to platform 32.

Figure 3:
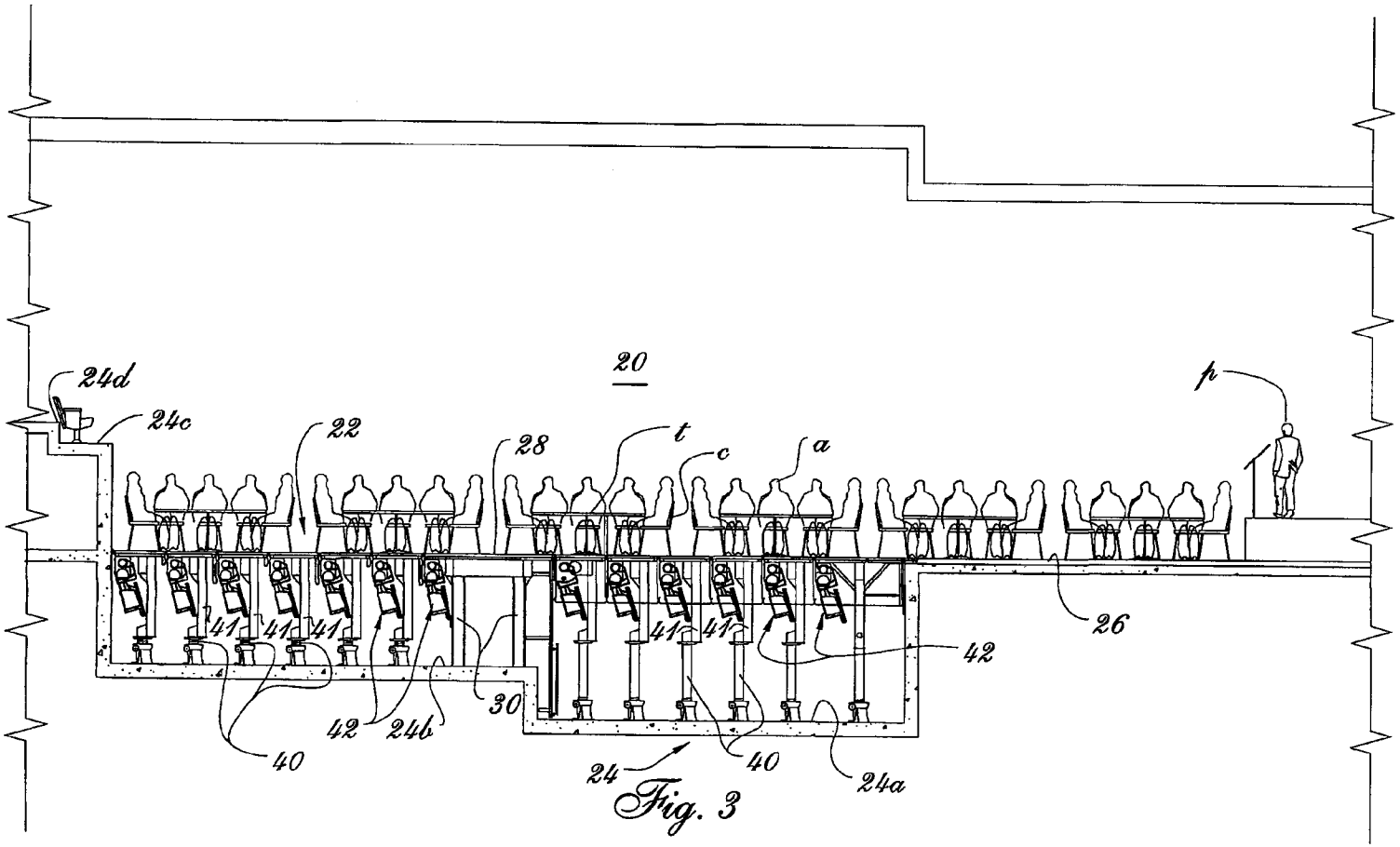
FIG. 3 is a view similar to FIG. 2, but with the seats being in an inoperative, concealed position, and further showing a number of attendants being seated on conventional chairs around conventional tables on top of the platforms of the removable seats system.

Each platform 32 is supported spacedly over ground and can be selectively independently vertically moved by a suitable selectively powered ground-resting platform support and displacement means which engages platforms 32 and which positions platforms 32 in the above-mentioned horizontally successively adjacent and slightly horizontally spaced configuration. More particularly, FIGS. 2, 3 and 4 show that each crossbar 38 is carried by and attached to the top portion of a number of spaced-apart vertically movable support posts 41 equipped with a corner iron 41*a* supporting crossbar 38. Push actuators 40 in turn carry posts 41 at their top extremity. Push actuators 40 can be for example hydraulic rams, or an intertwined spiral bands device such as the one disclosed in U.S. Pat. No. 4,875,660 issued in 1989 to inventors P. Gagnon and P. Laforest and as illustrated in the annexed drawings. Push actuators 40 stably rest on the ground, and are fixed thereto. Other suitable means for vertically moving platforms 32 could also be envisioned, for example vertical racks installed along the room walls with complementary selectively powered gear wheels mounted to the platforms. In this last embodiment, the vertical racks would be considered ground-resting to the extent that they must be attached to a ground resting structure such as support posts or opposite room walls. In the side elevations of figures 2 and 3 of the annexed drawings, the additional push actuators 40 and posts 41 assemblies supporting each platform 32 are concealed behind the push actuators 40 and posts 41 assemblies that can be seen. The push actuators 40 supporting a particular platform 32 can be activated independently-from the other push actuators 40 to allow independent vertical displacement of each platform 32.

Figure 5:
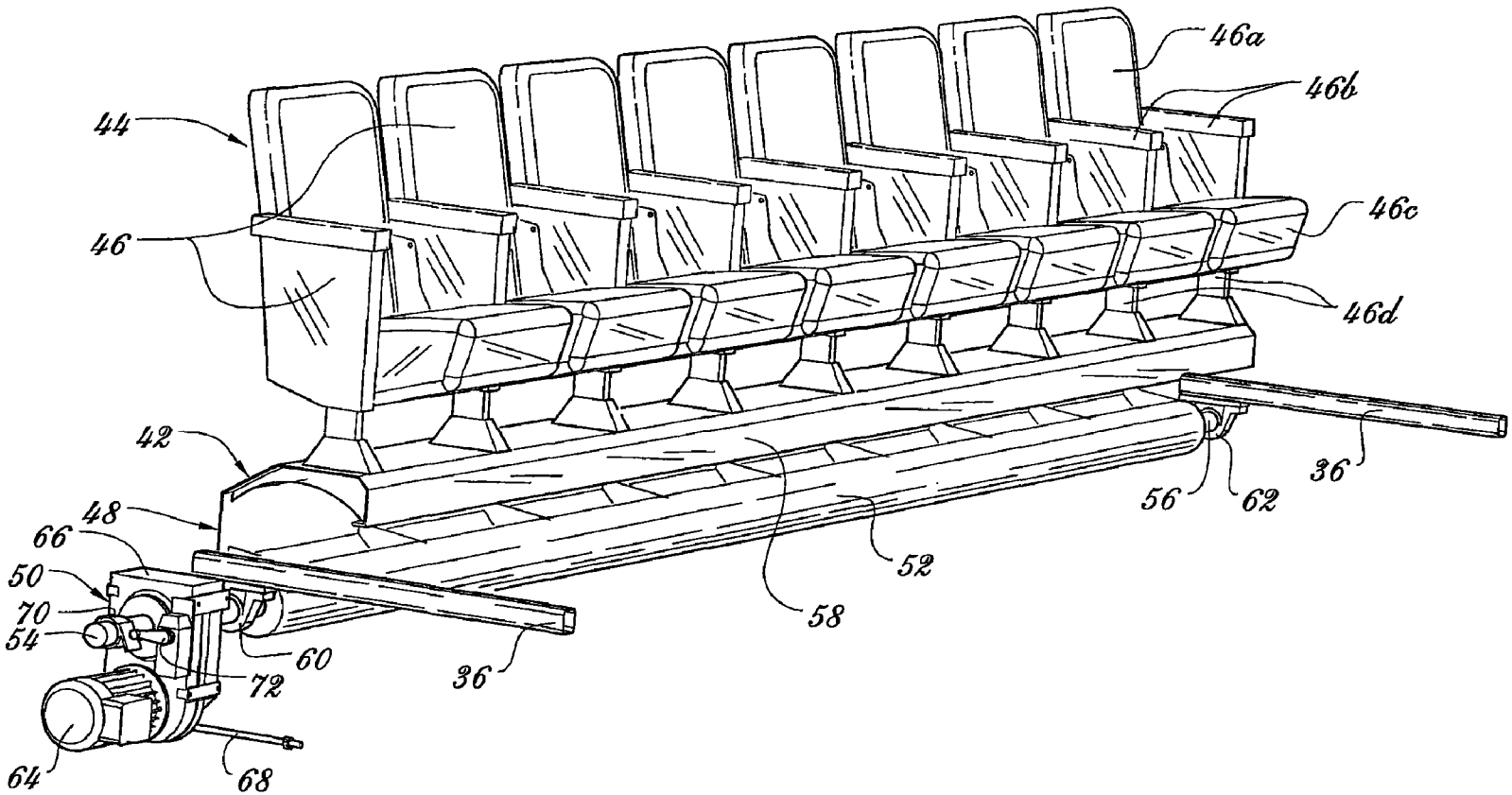
FIG. 5 is an enlarged top front perspective view of a seat member of the removable seats system of figured 1–3 together with a pair of cross-bars supporting the seat member.

As shown in FIGS. 2–6, removable seats system 22 further comprises a number of seat members 42 each associated to a corresponding platform 32 and each comprising a row of seats 44 comprising one or more seats 46, a seat supporting structure 48 carrying the row of seats 44, and a selectively powered seat displacement means 50 carried by platform 32. In one embodiment of the invention as shown in the drawings, each row of seats 44 comprises more than one seat 46, but it is understood that each platform could support as little as a single seat 46. Seats 46 can be conventional seats having a spring-loaded pivotable backrest 46*a*, armrests 46*b* pivotally supporting backrest. 46*a*, a load-bearing, spring-loaded pivotable cushioned seating plate 46*c* pivotally attached to armrests 46*b*, and foot members 46*d* supporting armrests 46*b* (FIG. 5). The spring-loaded, pivotable seating plate 46*c* and backrest 46*a* will automatically pivot into a substantially vertical contracted position when no-one is seated in seat 46, whereas the load of a person will extract backrest 46*a* into a rearwardly inclined position and seating plate 46*b* into a horizontal position. Each row of seats 44 can comprise seats 46 which are linked to each other, i.e. that they share an intermediate armrest 46*b*, or alternately each seat 46 can be individually supported by seat support structure 48. In any event, seats 46 are fixedly attached to seat support structure 48 by their foot members 46*d*.

In the embodiment illustrated in the annexed drawings, it can be seen that each platform 32 supports three rows of seats 44 with walkways 51 (FIG. 1) being formed longitudinally of room 20 between each laterally spaced-apart and angularly offset row of seats 44, although it is understood that each platform 44 could support as little as a single row of seats 44 or any suitable number thereof.

Seat support structure 48 can be seen in FIGS. 4–7. It comprises a cylindrical pivot 52 having diametrally smaller integral extremities 54, 56 which are short relative to the total length of pivot 52. Cylindrical pivot 52 carries a C-shaped reinforced plate 58 that is integrally fixed to cylindrical pivot 52, with seats 46 being fixedly attached on the top surface of C-shape plate 58. Thus, any pivotal movement of cylindrical pivot 52 results in a rotation of seats 46 about pivot 52.

Figure 7:
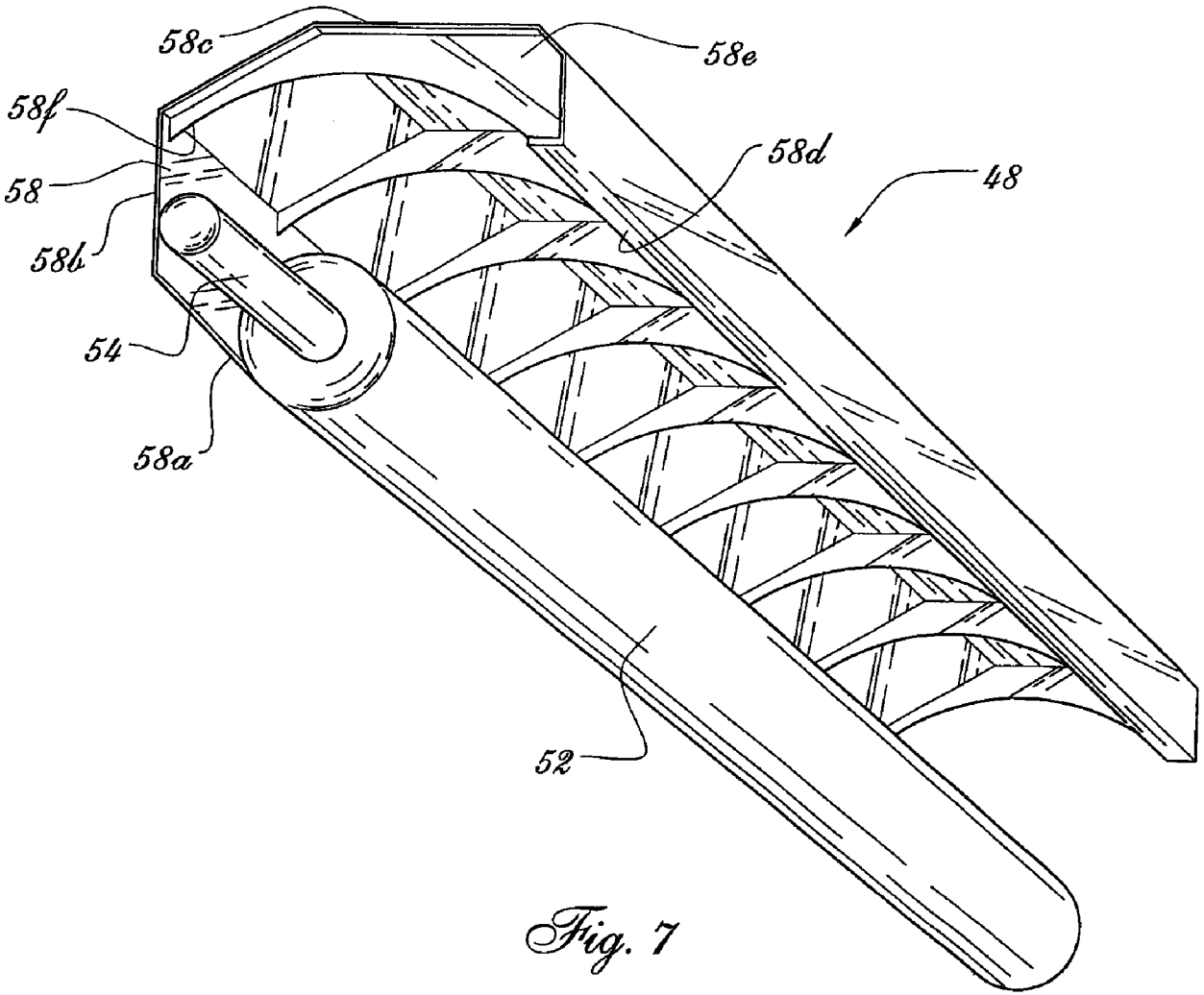
FIG. 7 is an enlarged bottom front perspective view of a seat supporting structure of a seat member of the removable seats system of FIGS. 1–3.

C-shaped plate 58, as seen in FIG. 7, comprises a reinforced lower portion 58*a* which is integrally attached to cylinder 52, an intermediate web portion 58*b*, a reinforced top portion 58*c* extending frontwardly into a marginal edge portion having a flat lower abutment surface 58*d*. Reinforcement ribs 58*e* extend along plate top portion 58*c* between web portion 58*b* and abutment surface 58*d*.

Figure 6:
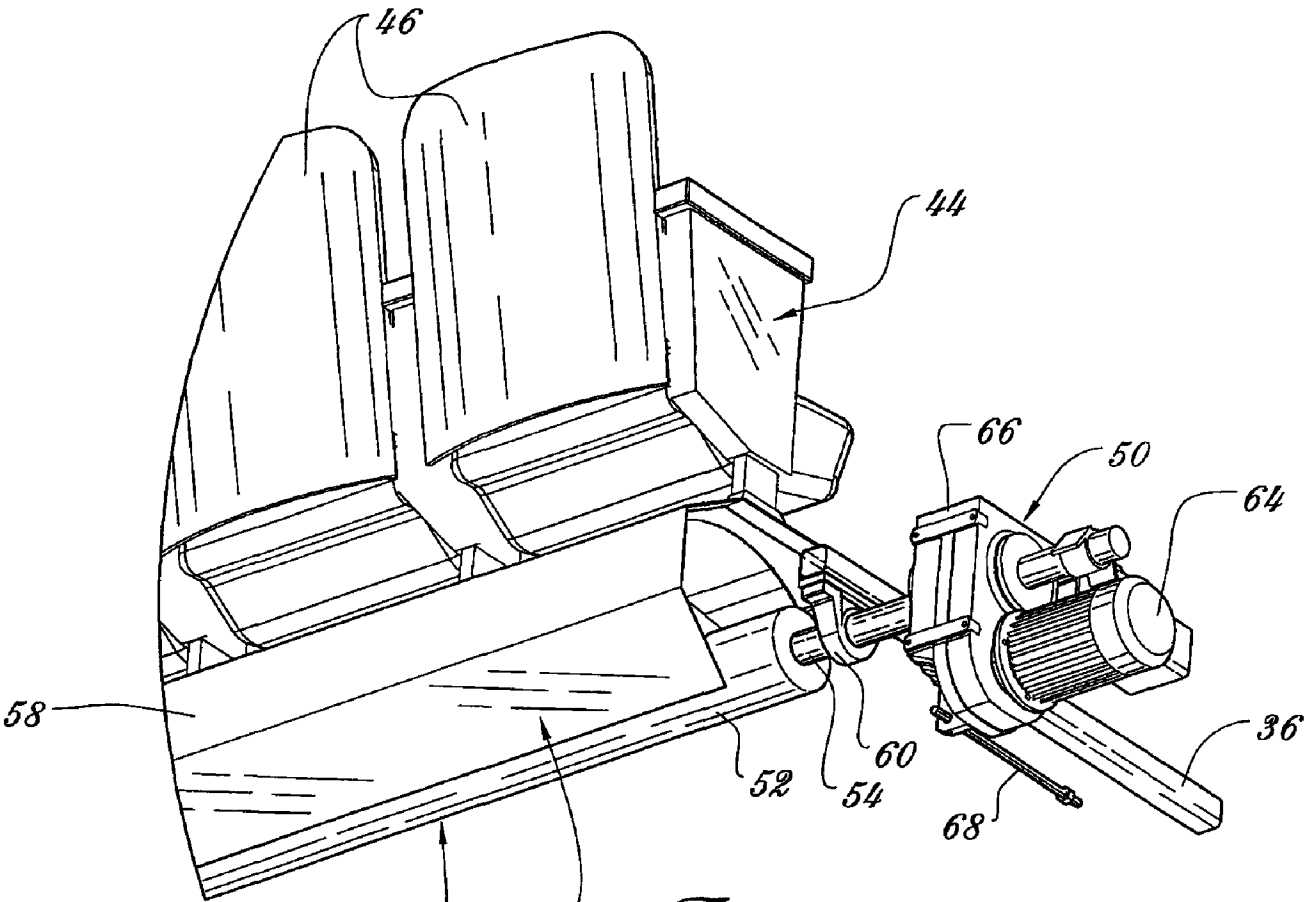
FIG. 6 is an enlarged partial bottom rear perspective view of the seat member of FIG. 5.

FIGS. 4–7 further show that seat member 42 is supported by a pair of spaced-apart bearing sleeves 60 and 62 engaged by the diametrally smaller pivot extremities 54 and 56 respectively. Sleeves 60, 62 are in turn fixedly attached under respective crossbars 36, 36, as shown in FIGS. 4–6. Sleeves 60, 62 include ball-bearings to allow frictionless pivotal movement of pivot 52.

Seat displacement means 50 includes power means in the form of an electric motor 64 coupled with and attached to a reduction box 66 including a reduction gear assembly (concealed in box 66 in the drawings). Reduction box 66 engages and is carried by pivot extremity 54. An anti-rotation rod 68 fixedly links reduction box 66 to the corresponding longitudinal tubular bar 38 (FIG. 4). Consequently, when motor 64 is activated, it transmits a rotational movement to the reduction gear assembly which in turn transmits a rotational movement to pivot 52 to forcibly rotate pivot 52 about its own axis, with anti-rotation rod 68 preventing the motor 64 and reduction box 66 assembly from simply rotating about pivot 52 without the latter moving due to the greater weight of seat supporting structure 48 and row of seats 44 compared to that of motor 64 and gear reduction box 66.

FIGS. 5 and 6 show that pivot extremity 54 extends through and beyond gear reduction box 66 and is provided with an integrally attached small U-shaped actuator plate 70 which co-operates with a switch 72 pivotally attached to box 66 and linked to motor 64. The purpose of switch 72 is to de-activate motor 64 to stop the rotational movement of seat member 42 when the latter reaches either one of two pre-determined limit positions described hereinafter. The relative position of switch 72 and actuator plate 70 is calibrated so that actuator plate engages switch 72 upon seat member 42 reaching either one of its two limit positions.

A manually activated control switch (not shown) allows motor 64 to be remotely activated.

Figure 8A:
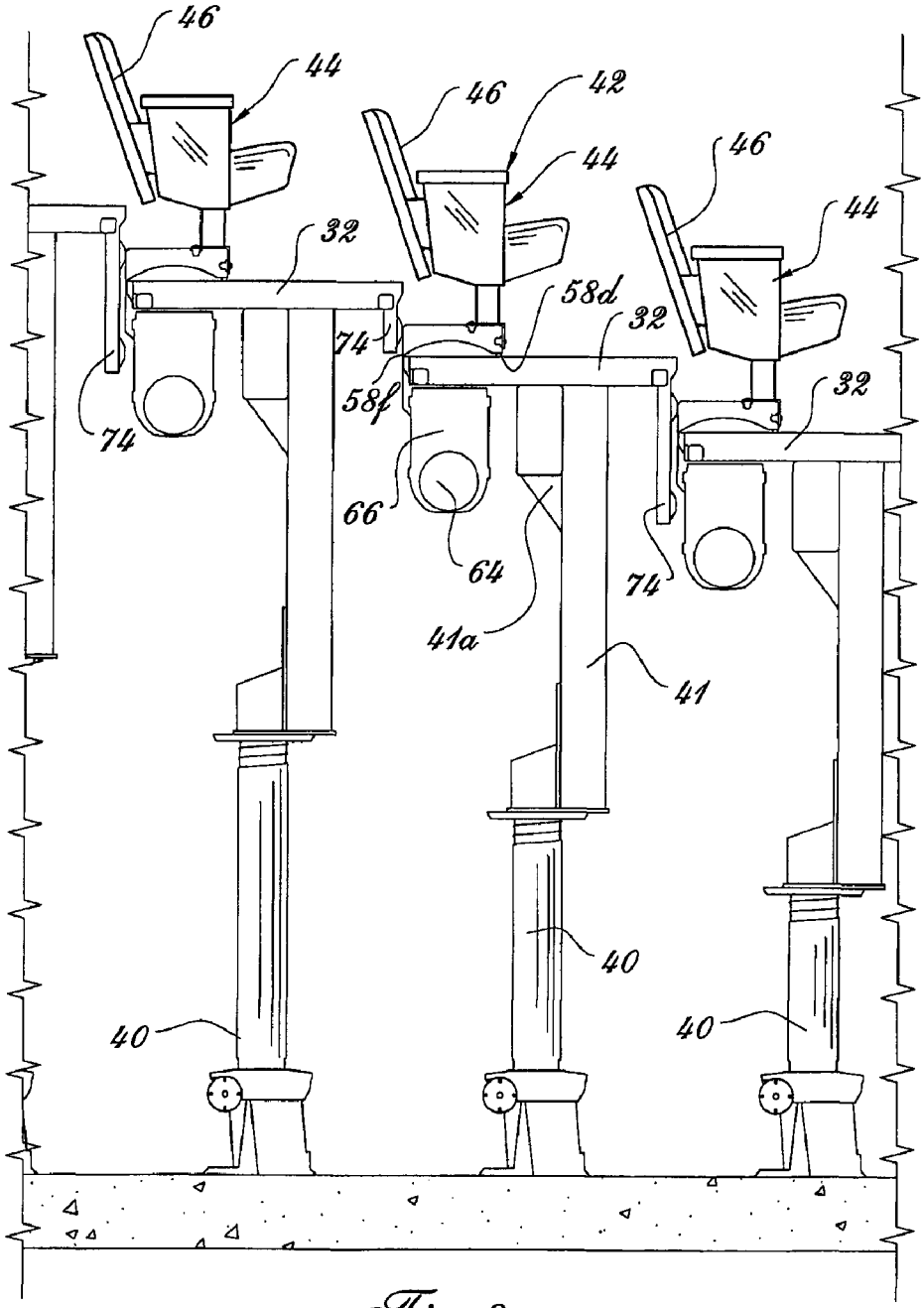
FIGS. 8*a* to 8*d* are enlarged cross-sectional side elevations of a portion of the removable seats system of FIGS. 1–3, sequentially showing how a seat member can be moved from an initial operative position into an inoperative concealed position.
Figure 8B:
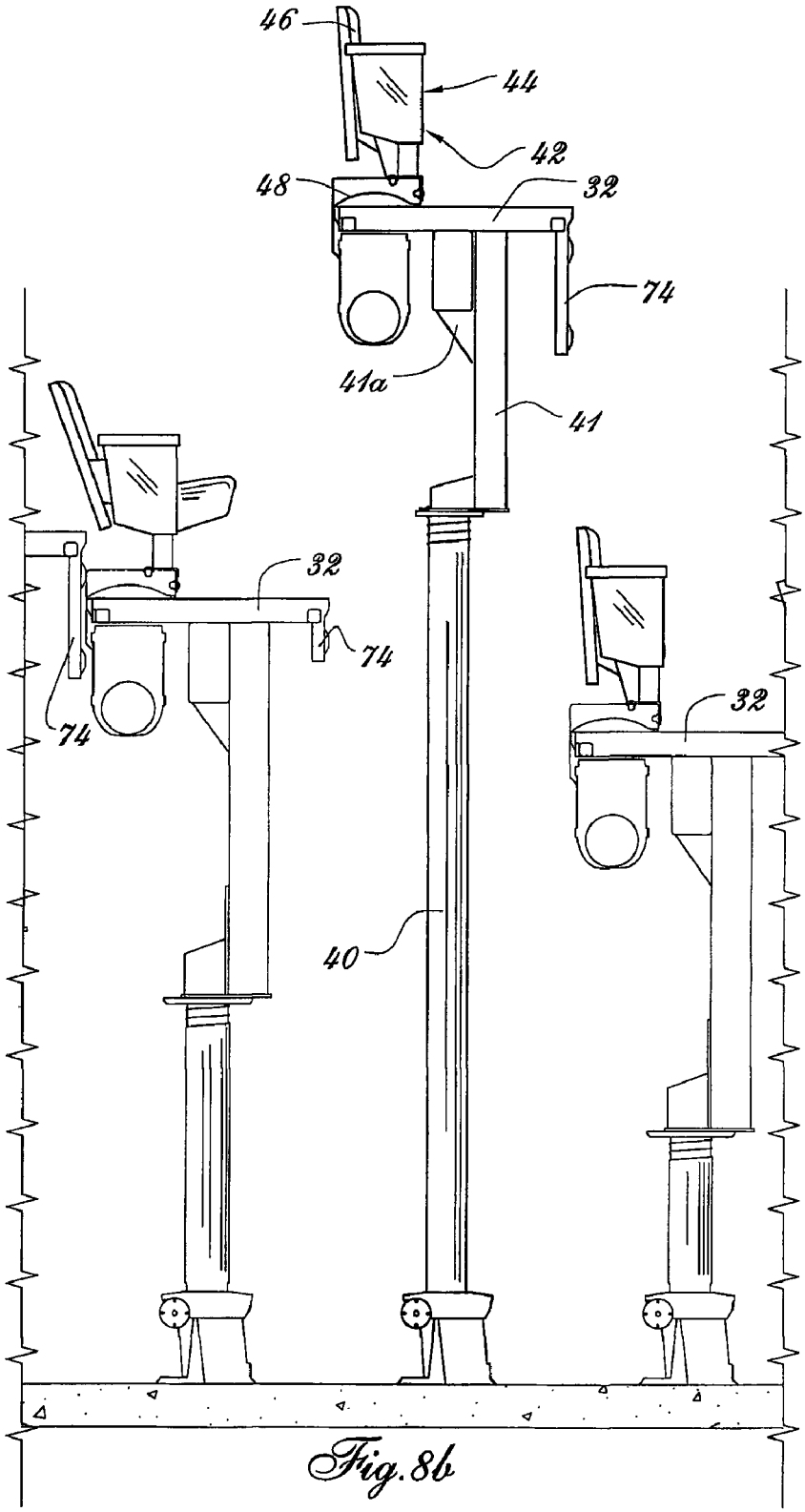
Figure 8C:
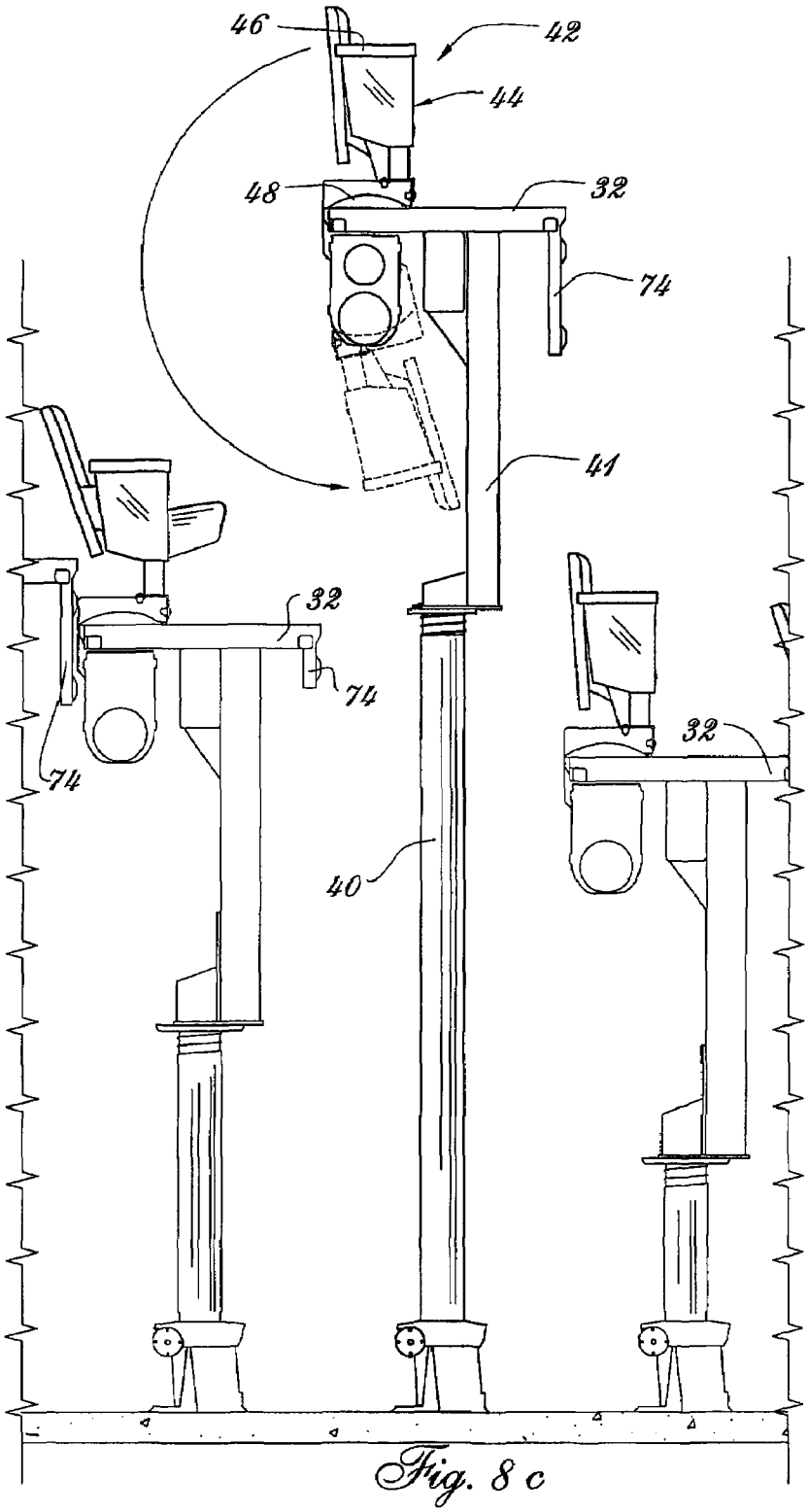
Figure 8D:
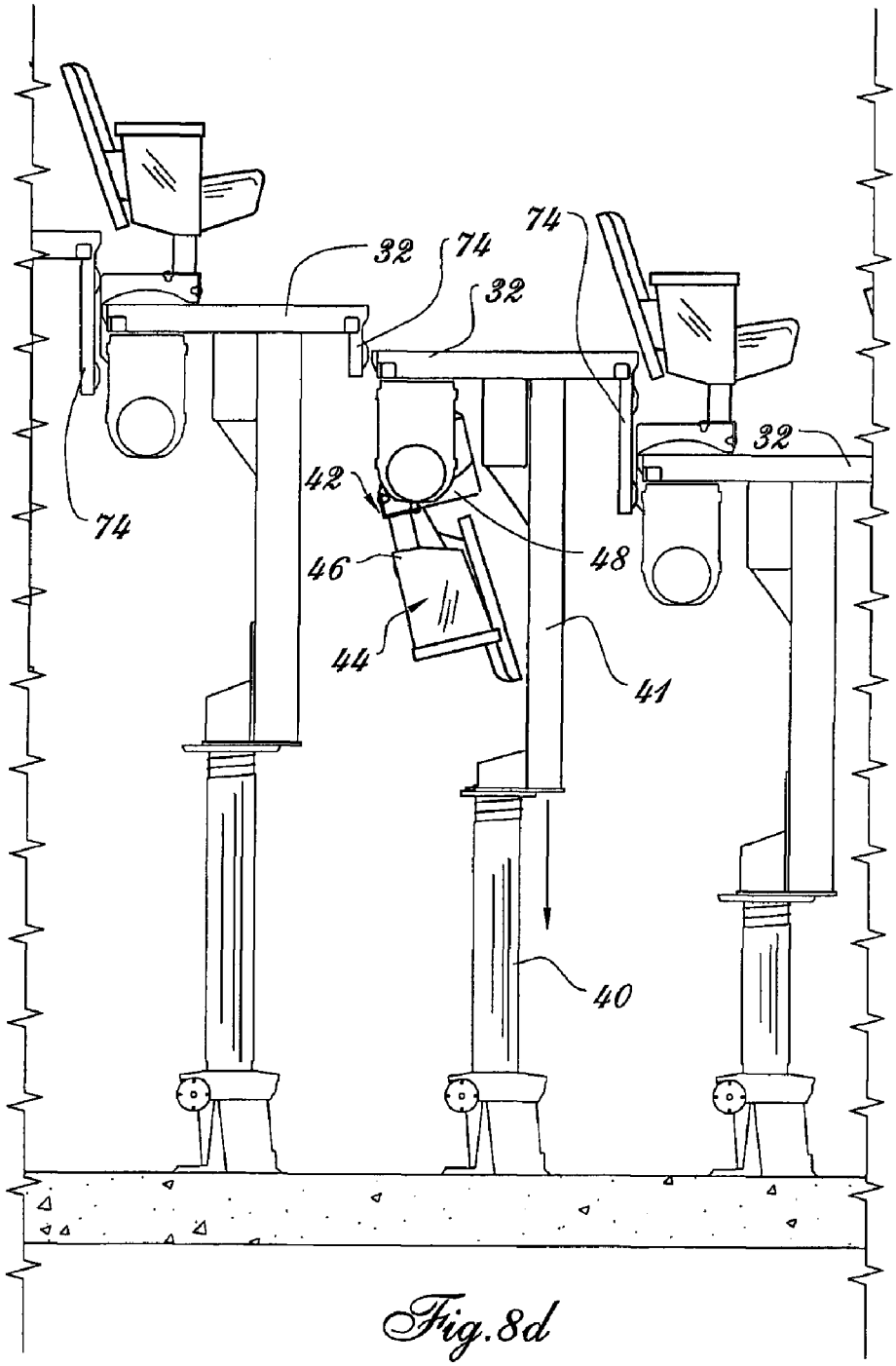

In use, as shown in FIGS. 8*a*, 8*b*, 8*c* and 8*d*, seat member 42 can move relative to its corresponding platform 32 between an operative position shown in FIGS. 8*a* and 8*b*, in which the row of seats 44 is located above platform 32 for allowing persons to sit on seats 46, and a concealed position shown in FIG. 8*d*, in which the row of seats 44 is located under platform 32 in an inoperative and concealed condition. Upon seat member 42 reaching either its operative position or its concealed position, switch 72 is activated to stop the pivotal movement of seat member 42.

FIGS. 8*a* to 8*d* show more particularly how a seat member 42 may be pivoted from its operative condition into its inoperative condition. The pivotal movement of seat member 42 occurs about the axis of cylindrical pivot 52.

In its operative condition shown in FIG. 8*a*, platform 32 is positioned at a desired height, for example to form gradually rearwardly rising rows of seats 44 as shown in FIGS. 2 and 8*a*. Each two successive platforms 32 may freely move vertically relative to each other. Each two successive platforms 32 are also slightly spaced horizontally to form a small gap between each other, as indicated hereinabove, to allow the C-shaped plate 58 of seat supporting structure 48 of each seat member 42 to extend through this gap. Indeed, since pivot 52 and the seat displacement means 50 are supported under platform 52 as explained hereinabove, and since the row of seats 44 is to be installed over platform 32 to allow operational use of seats 46, the C-shaped plate 58 of seat supporting structure 48 extends between two successive platforms 32. More particularly, the sheet-thick plate web portion 58*b* of plate 58 vertically extends between two successive platforms 32.

C-shaped plate 58 rests on platform 32 with its frontmost abutment surface 58*d* and with the rear portion 58*f* of reinforcement ribs 58*e* (FIGS. 7 and 8*a*). In this operative position of seat member 42, the floor formed by the platforms 32 seems uninterrupted for the persons resting thereon, since C-shaped plates 58 extends in the only gaps between the platforms and forms a jaw engaging the rear edge portion of platform 32. Also, as shown in FIGS. 8*a*–8*d*, platforms 32 are preferably provided with downwardly depending skirt boards 74 which are fixedly attached at the front edge of platforms 32 for preventing small objects from falling between and under vertically offset consecutive platforms 32 when seat members 42 are in their operative positions.

To move a seat member 42 into its concealed position, the push actuator of the associated platform 32 is first activated by a manual switch (not shown) to raise platform 32 until seat member 42 vertically clears any rearwardly located obstacle, such as the rearwardly located adjacent platform 32 and seat member 42 assembly, as shown in FIG. 8*b*. It is to be noted that the frontwardly adjacent seat backrest 46*a* needs to be upwardly pivoted from its rearwardly inclined position, to allow unhampered vertical motion of platform 32. A conventional spring-loaded backrest 46*a* will automatically adopt such an upwardly pivoted position when not loaded by a person's weight. Alternately, the relative position between a platform 32 and the frontwardly adjacent seat backrest 46*a* can be calibrated to prevent the seat backrest 46*a* from horizontally overlapping the platform vertical movement.

Then, seat member 42 is pivoted rearwardly by means of motor 64 into a downwardly oriented position adjacent post 41 and under platform 32, as shown in FIG. 8*c*, seat member 42 then hanging by its attachment to pivot 52. Finally, as shown in FIG. 8*d*, platform 32 can be lowered at a desired height. For example, all platforms 32 can be installed at a same height when seat members 42 are concealed, to form a conference room as shown in FIG. 3, wherein conventional ground-resting tables T and chairs C can be installed for seating attendants A hearing a conference person C, and wherein all seat members 42 are concealed and stored under their respective platforms 42.

In this concealed position of seat members 42, wherein platforms 32 form a flat floor spacedly above the room fixed floor structure 24, the small gaps between each two successive platforms 32 will be the only apparent feature hinting at a movable floor forming hybrid room 20. Since only the thin sheet-thick web portion 58*b* of seat supporting structure 48 needs to extend through this gap, the latter can consequently be relatively small, which consequently allows the floor formed by the adjacent platforms 32 in a conference room mode, to be flat and substantially featureless. The gap between two successive platforms 32 will be sized to snugly receive the sheet-thick web portion 58*b* of seat supporting structure 48.

The seat supporting structure 48 which extends around platform 32 allows the latter to be structurally whole, i.e. with no holes or slots required by the seat supporting structure or seat displacement means. This further allows the seat reinforcing structure formed by crossbars 36 and tubular bar 38 to substantially cover respectively the whole width and length of platform 32, which provides for a sturdy platform 32 structure. Persons walking on platform 32 thus do not have the impression that the floor formed by platforms 32 is flexible or movable.

As an alternate embodiment of the present invention, it is envisioned that the seat members be attached to the rearwardly adjacent platforms instead of the underlying corresponding platforms on which the seat members will be installed in their operative position. In such a situation, an articulated arm or a sliding track carried by the rearwardly adjacent platform could be used to move the seat members from their concealed position under the rearwardly adjacent platform, frontwardly onto the platform destined to support the seat members in their operational position. It is envisioned that the seat member be released onto its corresponding platform by the said articulated arm or track when installed in its operative position, and grasped by the articulated arm or track when it is to be retrieved. As with the present embodiment of the invention, the seat displacement means would still be located under a platform, and consequently the seat supporting structure would be similar to that shown in FIG. 7, with an intermediate portion extending between two successive platforms when the seat member is in its operative position.

It is further envisioned that the seat members be attached to the frontwardly adjacent platforms instead of the underlying platforms, with an articulate arm or sliding track allowing the seat to be moved onto the rearwardly adjacent platform when required.

Consequently,although the seat member will be positioned over its corresponding platform in its operative positions it may be positioned under its corresponding platform, under the rearwardly adjacent platform or under the frontwardly adjacent platform when it is in its concealed position.

It is understood that although the removable seats system of the present invention has been shown and described for use in a theatre room throughout the present specification, it could be used in other contexts without departing from the scope of the present invention.

Any modifications to the present invention, which do not deviate from the scope thereof, are considered to be included therein.

We claim:

1. A removable seats system comprising a number of vertically movable platforms supported spacedly over ground by a ground-resting platform support and displacement means which engages said platforms and which positions said platforms in a horizontally successively adjacent although slightly horizontally spaced configuration so as to define a small horizontal gap between each two successive said platforms, said platform support and displacement means further allowing selective independent vertical displacement of said platforms, said removable seats system further comprising a number of seat members each associated to a corresponding said platform and each comprising:

a row of seats comprising at least one seat; and a seat supporting structure carried by a said platform and supporting said row of seats;

wherein each one of said seat members is movable relative to said corresponding platform between an operative position in which said row of seats is located above said corresponding platform for allowing persons to sit on said seats, and a concealed position in which said row of seats is carried by and is located under a said platform in an inoperative and concealed condition, and wherein in said operative position of each one of said seat members, said seat supporting structure extends through said gap between two said successive platforms.

2. A removable seats system comprising:

a number of selectively powered vertically movable platforms supported spacedly over ground by a ground-resting platform support and displacement means which engages said platforms and which positions said platforms in a horizontally successively adjacent although slightly horizontally spaced configuration so as to define a small horizontal gap between each two successive said platforms, said platform support and displacement means further allowing selective independent vertical displacement of said platforms; and a number of seat members each associated to a corresponding said platform and each comprising:

a row of seats comprising at least one seat;

a seat supporting structure carrying said row of seats; and a selectively powered seat displacement means carried by said corresponding platform and carrying said seat supporting structure, said seat displacement means being capable of moving said seat member relative to said corresponding platform between an operative position in which said row of seats is located above said corresponding platform for allowing persons to sit on said seats, and a concealed position in which said row of seats is located under said corresponding platform in an inoperative and concealed condition;

wherein in said operative position of each one of said seat members, said seat supporting structure is supported under said corresponding platform by said seat displacement means and extends through said gap between two said successive platforms to rest over said corresponding platform and support said row of seats over said corresponding platform, and wherein in said inoperative position of said seat members, said platforms may be aligned at a same height to form a flat surface which is substantially featureless.

3. A removable seats system as defined in claim 2, wherein at least two said seat members are associated to each one of said platforms.

4. A removable seats system as defined in claim 2, wherein each said vertically movable platform defines a top and a bottom surface and comprises a reinforcing structure which extends for substantially the whole width and length of said platform on said bottom surface of said platform.

5. A removable seats system as defined in claim 2, wherein said platform support and displacement means comprises a number of push actuators corresponding to each one of said platforms, said push actuators resting on the ground, being attached to said platforms and allowing said platforms to be selectively independently vertically displaced through selective activation of said push actuators.

6. A removable seats system as defined in claim 2, wherein each said seat supporting structure includes an intermediate sheet-thick web portion which extends through said gap in said operative position of said seat member including said seat supporting structure, said gap being sized to snugly receive said sheet-thick web portion of said seat supporting structure.

7. A removable seats system as defined in claim 6, wherein said seat supporting structure includes a pivot member pivotally carried by said corresponding platform and a first portion fixedly attached to said pivot member, an intermediate web portion formed by said sheet-thick web portion, and a second portion opposite said first portion with said row of seats being fixed to said second portion, and wherein said seat displacement means comprises a selectively powered pivoting device engaging said pivot member and selectively pivoting said pivot member for pivotally moving said seat member between said operative position and said concealed position.

8. A removable seats system as defined in claim 7, wherein each said seat supporting structure first portion, intermediate web portion and second portion define a C-shaped plate forming a jaw engaging an edge portion of said platform.

9. A removable seats system as defined in claim 8, wherein each said seat supporting structure second portion comprises a marginal edge portion having an abutment surface which rests on said corresponding platform in said operative position of said seat member including said seat supporting structure.

10. A removable seats system comprising:

a number of selectively powered vertically movable platforms supported spacedly over ground by a ground-resting platform support and displacement means which engages said platforms and which positions said platforms in a horizontally successively adjacent although slightly horizontally spaced configuration so as to define a small horizontal gap between each two successive said platforms, said platform support and displacement means further allowing selective independent vertical displacement of said platforms; and a number of seat members each associated to a corresponding said platform and each comprising:

a row of seats comprising at least one seat;

a seat supporting structure carrying said row of seats; and a selectively powered seat displacement means carried by said corresponding platform and capable of carrying said seat supporting structure, said seat displacement means being capable of moving said seat member relative to said corresponding platform between an operative position in which said row of seats rests on and is located above a supporting platform for allowing persons to sit on said seats, and a concealed position in which said row of seats is located under said corresponding platform in an inoperative and concealed condition;

wherein in said operative position of each one of said seat members, said seat supporting structure extends through said gap between two said successive platforms to rest over said supporting platform and support said row of seats over said supporting platform, and wherein in said inoperative position of said seat members, said platforms may be aligned at a same height to form a flat surface which is substantially featureless.

11. A removable seats system as defined in claim 10, wherein for each one of said seat members, said supporting platform is the same as said corresponding platform.

* * * * *